US009266701B2

(12) United States Patent
Bosco et al.

(10) Patent No.: US 9,266,701 B2
(45) Date of Patent: Feb. 23, 2016

(54) ENHANCED STABILITY CRANE AND METHODS OF USE

(76) Inventors: Eli Bosco, Broomfield, CO (US); Christopher Desrochers, Thorton, CO (US)

( * ) Notice: Subject to any disclaimer, the term of this patent is extended or adjusted under 35 U.S.C. 154(b) by 0 days.

(21) Appl. No.: 14/346,823

(22) PCT Filed: Jul. 14, 2012

(86) PCT No.: PCT/US2012/046820

§ 371 (c)(1),
(2), (4) Date: Mar. 24, 2014

(87) PCT Pub. No.: WO2013/012761

PCT Pub. Date: Jan. 24, 2013

(65) Prior Publication Data

US 2014/0202971 A1 Jul. 24, 2014

Related U.S. Application Data

(60) Provisional application No. 61/508,442, filed on Jul. 15, 2011.

(51) Int. Cl.

| | |
|---|---|
| ***B66C 23/68*** | (2006.01) |
| ***B66C 23/18*** | (2006.01) |
| ***B66C 23/20*** | (2006.01) |
| ***B66C 23/30*** | (2006.01) |
| ***B66C 23/42*** | (2006.01) |

(52) U.S. Cl.

CPC ..... *B66C 23/185* (2013.01); *B66C 23/207* (2013.01); *B66C 23/208* (2013.01); *B66C 23/30* (2013.01); *B66C 23/42* (2013.01); *B66C 23/68* (2013.01)

(58) Field of Classification Search

CPC ..... B66C 23/18; B66C 23/185; B66C 23/20; B66C 23/203; B66C 23/207; B66C 23/208; B66C 23/42; B66C 23/68

USPC ..... 212/294, 295, 296, 299, 300, 199, 202, 212/204

See application file for complete search history.

(56) References Cited

U.S. PATENT DOCUMENTS

| | | | |
|---|---|---|---|
| 6,655,539 | B2 | 12/2003 | Bertinotti |
| 2010/0101086 | A1 | 4/2010 | Amram |
| 2010/0176078 | A1 | 7/2010 | Conrad et al. |

FOREIGN PATENT DOCUMENTS

| | | | |
|---|---|---|---|
| JP | 09-202589 | | 8/1997 |
| JP | 2009-113922 | | 5/2009 |
| JP | 2012091897 A | * | 5/2012 |
| JP | 2012092534 A | * | 5/2012 |

* cited by examiner

*Primary Examiner* — Sang Kim
*Assistant Examiner* — Juan Campos, Jr.
(74) *Attorney, Agent, or Firm* — Leyendecker & Lemire, LLC

(57) ABSTRACT

An enhanced stability crane (100) is described. Embodiments include a telescoping main support mast (114) upon which a crane base (106) resides. A boom (140) projects upwardly from the crane base and a jib (148) typically projects upwardly from the boom. A clamping assembly (108) resides on the main support mast and is configured to attach to an existing structure adjacent to the crane, in order to enhance stability. Multiple clamping assemblies can be distributed along the telescoping main support mast when it is extended. The existing structure is generally a tower structure (180) that is columnar and vertical in shape and orientation, and frequently has an elliptical horizontal cross-section. Tower structures are typically, but not necessarily, wind turbine towers. In some embodiments, the crane is mobile capable of lifting objects weighing about 110 tons to a height of about 400 feet. The crane typically adjusts to a collapsed configuration, enabling facile transport.

17 Claims, 11 Drawing Sheets

ENHANCED STABILITY CRANE AND METHODS OF USE

The present patent application claims priority to and incorporates by reference in its entirety, U.S. patent application Ser. No. 61/508,442, filed 15 Jul. 2011, having the same inventors as the present application and titled ENHANCED-STABILITY, HEAVY-DUTY, TELESCOPING CRANE AND METHODS OF USE.

BACKGROUND

Large capacity, long-boom cranes are often required for building or assembling structures. Some cranes such as tower cranes are typically assembled on site and disassembled after work is completed. However, for many applications a more mobile, easily deployable crane is more suitable.

Where mobile telescoping cranes are larger and/or their duty loads increase, stability challenges arise. For example, as counterweight is added to a crane, rearward stability problems can manifest, particularly when the crane is on sloping ground. Some large telescoping cranes perform similarly to traditional tower cranes. When fully extended, telescoping members are oriented almost completely vertically, with a crane base, jib, masts, and boom disposed at the end of the telescoping members. As such a crane extends to greater heights, it is increasingly vulnerable to stress from loads and winds, to the detriment of the crane's stability and structural integrity.

One attempt to address this issue is with the Grove® GTK1100 mobile crane, manufactured by Manitowoc Companies, Inc. Among disadvantages of the GTK1100 solution is its requirement for multiple elevated outriggers disposed under the boom of the crane. Each of the elevated outriggers is coupled to the ground via multiple hinged or articulated supports anchored near ground-level outriggers. The elevated outrigger solution results in much additional hardware and weight, as well as a relatively large ground footprint, which can interfere with crane operations.

The elevated outriggers typically project laterally from a crane support structure at least 40 feet above the ground. The elevated outriggers are typically substantially horizontally disposed, and can project from a crane support structure at heights of preferably at least 80 feet above ground, more preferably at least 155 feet above ground, still more preferably at least 230 feet above ground, and most preferably at least 280 feet above ground. Each elevated outrigger typically has its own connection anchoring the elevated outrigger to the ground. Elevated outriggers typically do not attach to a tower structure for stability or support.

Accordingly, a need exists for a heavy-duty crane having greater stability and greater mobility. Decreased footprint and reduced size and weight are also desired.

DETAILED DESCRIPTION

Figure 1:
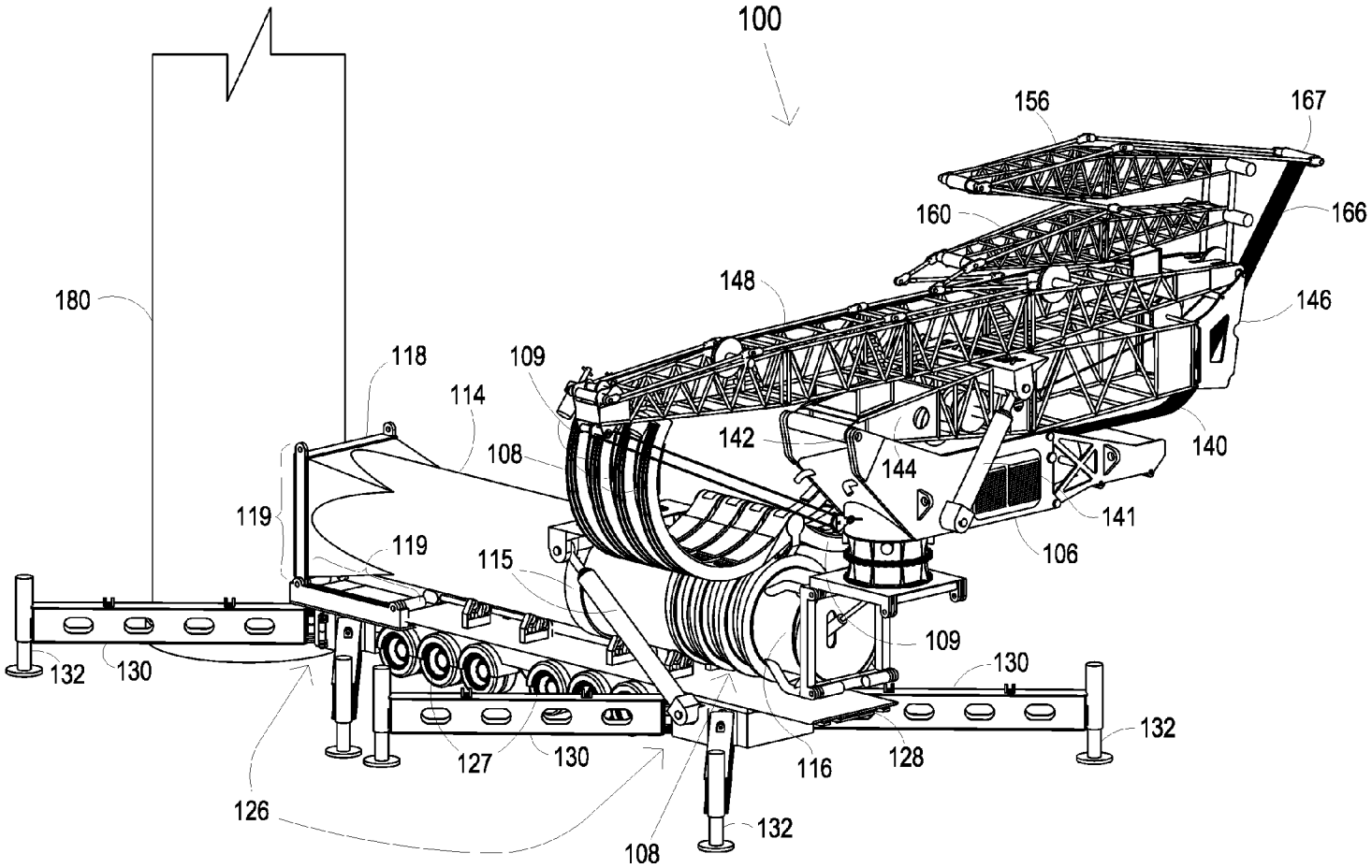
FIG. 1 is a perspective view of an enhanced stability crane in a fully collapsed configuration according to an embodiment of the present invention.

Embodiments of enhanced stability cranes according to the present invention include a telescoping crane having enhanced stability compared to prior art cranes. Embodiments of enhanced stability cranes are remote-controlled rather than having an operator stationed in the crane base. In some embodiments, the crane is capable of lifting objects weighing about 110 tons to a height of about 400 feet. The crane typically includes a telescoping main support mast upon which a crane base resides. A boom and jib project upwardly from the crane base.

A clamping assembly resides on the main support mast and is configured to attach to a structure adjacent to the crane, in order to enhance stability. Multiple clamping assemblies can be distributed along the telescoping main support mast when the mast is extended. The structure is generally a tower structure that is columnar and vertical in shape and orientation, and frequently has an elliptical horizontal cross-section. Tower structures are typically, but not necessarily, wind turbine towers. Embodiments of enhanced stability cranes are portable and thus readily adapted to be moved and set up at a new location.

Embodiments of enhanced stability cranes present numerous advantages over the prior art, including but not limited to:

- reduced turning moment;
- reduced requirement for counterweight mass and moment;
- reduced overall size and mass;
- can be transported by fewer trucks, and in some instances by as few as five tractor trailer rigs;
- reduced footprint with concomitant reduction in ground preparation;
- no need for elevated outriggers to stabilize a crane support structure or boom;
- greater on-site maneuverability;
- faster assembly and disassembly;
- non-existent ground-level tail swing during operation;
- greater ability to operate during high winds and other inclement weather;
- 360 degree turning with hoist mechanism residing above structure height.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply regardless of the word or phrase's case, and to singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "operatively coupled," as used in this specification and appended claims, refers to a physical connection between identified elements, components, or objects, wherein operation of one of the identified elements, components, or objects, results in operation of an other of the identified elements, components, or objects. For example, where multiple tension members 165 are operatively coupled to a boom drum 111 (see FIG. 9) via the cable cluster 166 and the yoke 167, operation of the boom drum to reel in or unreel the cable cluster causes the multiple tension members to perform a function (i.e. to operate). In this case, the function is to change position or orientation of the jib 148, first boom mast 156, or second boom mast 160.

The terms "removable", "removably coupled", "removably disposed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term "tower structure," as used in this specification and appended claims, refers to substantially vertically oriented structures including, but not limited to, wind turbine towers and smoke stacks, or parts thereof. Tower structures are typically, but not necessarily, cylindrical, conical, or approximately cylindrical or conical. For example, wind turbine towers and smoke stacks typically taper toward their tops, and may thus not be strictly cylindrical, but may be characterized as approximately cylindrical. Despite tapering toward the top, they may not be strictly conically shaped either, but may be characterized as approximately conical. Some tower structures are hyperboloid, and are thus narrower at a midsection and wider at a top and bottom. A tower structure typically has a horizontal cross-section that is elliptical. The elliptical horizontal cross-section is typically, but not necessarily, circular. Some columnar structures have cross-sections that are polygonal. The polygonal cross-sections are typically, but not necessarily, straight sided regular polygons.

The term "wind turbine," as used in this specification and appended claims, refers to devices designed and configured to harness wind energy, and includes devices commonly referred to as windmills, wind chargers, wind pumps, wind power plants, and wind turbines.

The terms "substantially vertical," "substantially vertically oriented," and similar terms, as used in this specification and appended claims, refer to an orientation within 7.5 degrees of vertical. Where a structure or device is referred to as being "substantially vertically" oriented, it means a centrally disposed longitudinal axis of the structure or device is within 7.5 degrees of vertical.

The terms "substantially horizontal," "substantially horizontally oriented," and similar terms, as used in this specification and appended claims, refer to an orientation within 22.5 degrees of horizontal. Where a structure or device is referred to as being "substantially horizontally" oriented, it means a central longitudinal axis of the structure of device is within 22.5 degrees of horizontal.

The term "proximate," when used in this specification and appended claims to describe a location with respect to a structure end or terminus, means being within 20% of the structure length of the end or terminus. For instance, where a jib is pivotably coupled to a boom proximate a second end of the boom, and the boom is 60.1 feet long, the jib is coupled to the boom within 12.02 feet of the boom second end.

The term "at," when used in this specification and appended claims to describe a location with respect to a structure end or terminus, means being within 5% of the structure length of the structure end or terminus. For instance, where a boom is pivotably coupled to a crane base at a boom first end and the boom is 37.6 feet long, the boom is coupled to the crane base within 1.88 feet of the boom first end.

The term "crane load," as used in this specification and appended claims, refers to a load lifted or lowered by the crane while being suspended from the boom or jib. The crane load is typically, but not necessarily, also moved laterally by the crane. The crane load is typically not a component of the crane.

The term "approximately," as used in this specification and appended claims, refers to plus or minus 10% of the value given.

The term "about," as used in this specification and appended claims, refers to plus or minus 20% of the value given.

Except where the terms "substantially horizontal" or "substantially vertical" are recited, the term "substantially," as used in this specification and appended claims, means mostly, or for the most part.

The term "generally," as used in this specification and appended claims, means mostly, or for the most part.

A First Embodiment Enhanced Stability Crane

A first embodiment enhanced stability crane 100 is illustrated in FIGS. 1-10. The crane 100 is shown in a fully collapsed configuration in FIGS. 1 and 2, partially collapsed and progressively more deployed in FIGS. 3-6, and in a fully deployed configuration in FIGS. 7-10. The first embodiment enhanced stability crane 100 comprises a crane base 106, which includes a power source 107 residing within. The power source of the first embodiment is an Hino® P11C-TI six cylinder diesel engine, with direct fuel injection and a turbocharger with intercooler, and having a dry weight of approximately 2100 lbs. The Hino diesel generates 245 kW power at 1850 rpm, and 1353 Newton-meters of torque at 1400 rpm. Various embodiments comprise other power sources including, but not limited to, other diesel engines, gasoline engines, electric motors, diesel-electric hybrids, and other combustion-electric hybrid power plants. In some embodiments, the power source can include multiple motors or engines. For example, a first engine or motor can be used to for load lifting and a second engine or motor can be used to rotate the crane base 106.

The crane base 106 resides on a main support mast 114, which can be referred to as a main mast. The main support mast 114 of the first embodiment comprises multiple telescoping sections in order to have variable length capability. Other variations include a main support mast having a fixed length. The crane base 106 is disposed at a first end 116 of the main support mast. Multiple clamping assemblies 108 are coupled directly to the main support mast 114. The clamping assemblies are configured to grasp a tower structure by use of grasping members 109. The grasping members 109 of the first embodiment crane 100 are horizontally opposed arcuate appendages configured to grasp or clamp a tower structure with a pincer-like action. The clamping assemblies generally grasp the tower with substantially uniform pressure, and typically, but not necessarily, apply pressure of about 10 pounds per square inch or less to the tower structure during grasping, in order to avoid damaging the tower. The grasping appendages are typically, but not necessarily, electrically actuated. Embodiments include hydraulically or pneumatically actuated grasping appendages. The clamping assemblies grasp or clamp the tower structure in a readily releasable manner, and typically do not attach to the tower structure with bolts or other threaded fasteners that run from a clamping assembly to a tower structure. Similarly, the clamping assemblies are not welded or otherwise permanently or semi-permanently affix to the tower structure.

The arcuate appendages include a relatively plastic material disposed on their surfaces configured to contact the tower structure, in order to reduce incidence of scratching, denting, or otherwise marring or damaging the tower structure. The relatively plastic material can be polyethylene or other material including, but not limited to, natural or synthetic polymers, cork, composites, fabric, or elastomeric material.

In some embodiments, grasping members include flexible bands or straps that wrap a tower circumference and tighten thereupon. The flexible bands or straps can include metals and metal alloys. Variations of flexible bands or straps comprise fibers including, but not limited to, Kevlar® and other aramid fibers, polyolefin fiber, polyester fiber, glass fiber, and carbon fiber. The fibers can be utilized in woven and non-woven fabric. For the purposes of this specification and appended claims, aramid includes para-aramid, meta-aramid, and other long-chain synthetic polyamides.

Embodiments of grasping members include inflatable chambers configured to expand against the tower structure when inflated. The inflatable chambers inflate by filling with fluid under positive pressure. The fluid is typically a non-flammable gas such as, but not limited to air or nitrogen. Variations include chambers having outer membranes comprising polyvinyl chloride (PVC) coated fabric, urethane coated fabric, or chlorosulfonated polyethylene. In some embodiments, the chambers include bladders residing within the outer membranes. The bladders typically, but not necessarily, comprise urethane or PVC.

Figure 2:
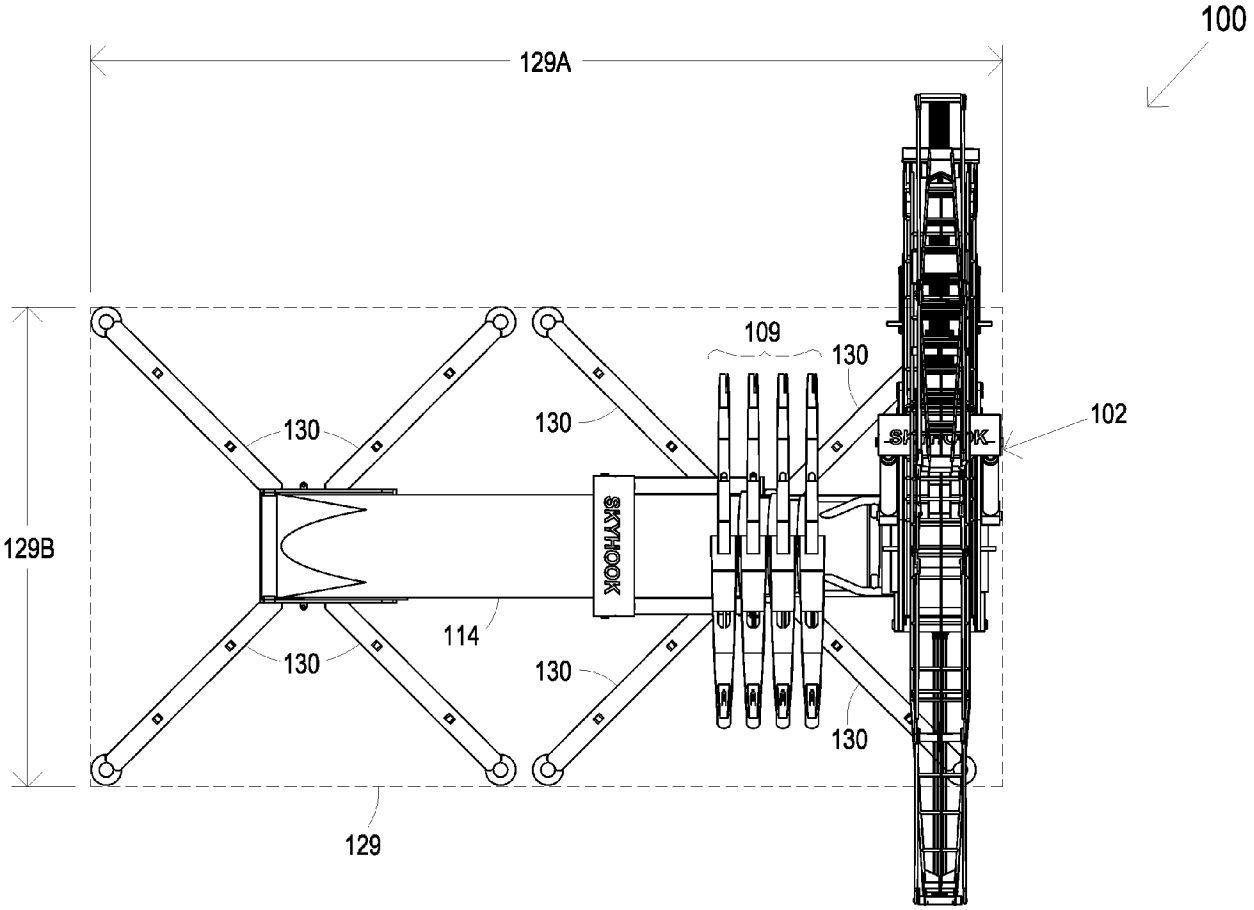
FIG. 2 is an overhead, plan view of an enhanced stability crane in a fully collapsed configuration, with the platform assembly in an operational configuration, according to an embodiment of the present invention.

A main mast second end 118 is coupled directly to a platform assembly 126. The platform assembly 126 of the first embodiment comprises a trailer bed 128. Multiple ground-level outriggers 130 attach to the platform assembly and engage the ground in order to provide a stable platform. The outriggers 130 include jacks 132 adapted to accommodate variations in ground surface variability. The outriggers 130 of the first embodiment are typically removed for transport. An operational configuration of the platform assembly 126, which includes eight outriggers 130 installed, is illustrated in FIGS. 1-8 and 10. In the operational configuration, the platform assembly is configured to support the crane 100 during operation. As best seen in FIG. 2, a footprint 129 of the operational configuration includes a footprint length 129A of about 75 feet and a footprint width 129B of about 39.25 feet, resulting in a footprint area of about 2944 square feet. Embodiments include footprints preferably smaller than 3900 square feet, more preferably smaller than 3450 square feet, and most preferably smaller than 3000 square feet. For the purposes of this specification and appended claims, a crane footprint is defined as the smallest rectangle that will encompass all parts of a crane that are in contact with the ground.

The platform assembly 126 also serves as a trailer or semi-trailer for transporting the crane 100. The platform assembly thus includes wheels 127 configured to bear the crane 100 in its fully collapsed configuration, and to roll at highway speeds with the crane so borne. The platform assembly 126 further includes a mast cradle 133 for cradling the main support mast 114 on the platform assembly 126 when the mast 114 resides in a prone orientation, as shown in FIG. 1. The mast cradle 133 can include rollers or other devices adapted to enable the main support mast to move horizontally on the platform assembly 126, as indicated by arrow 131 in FIG. 3.

Figure 3:
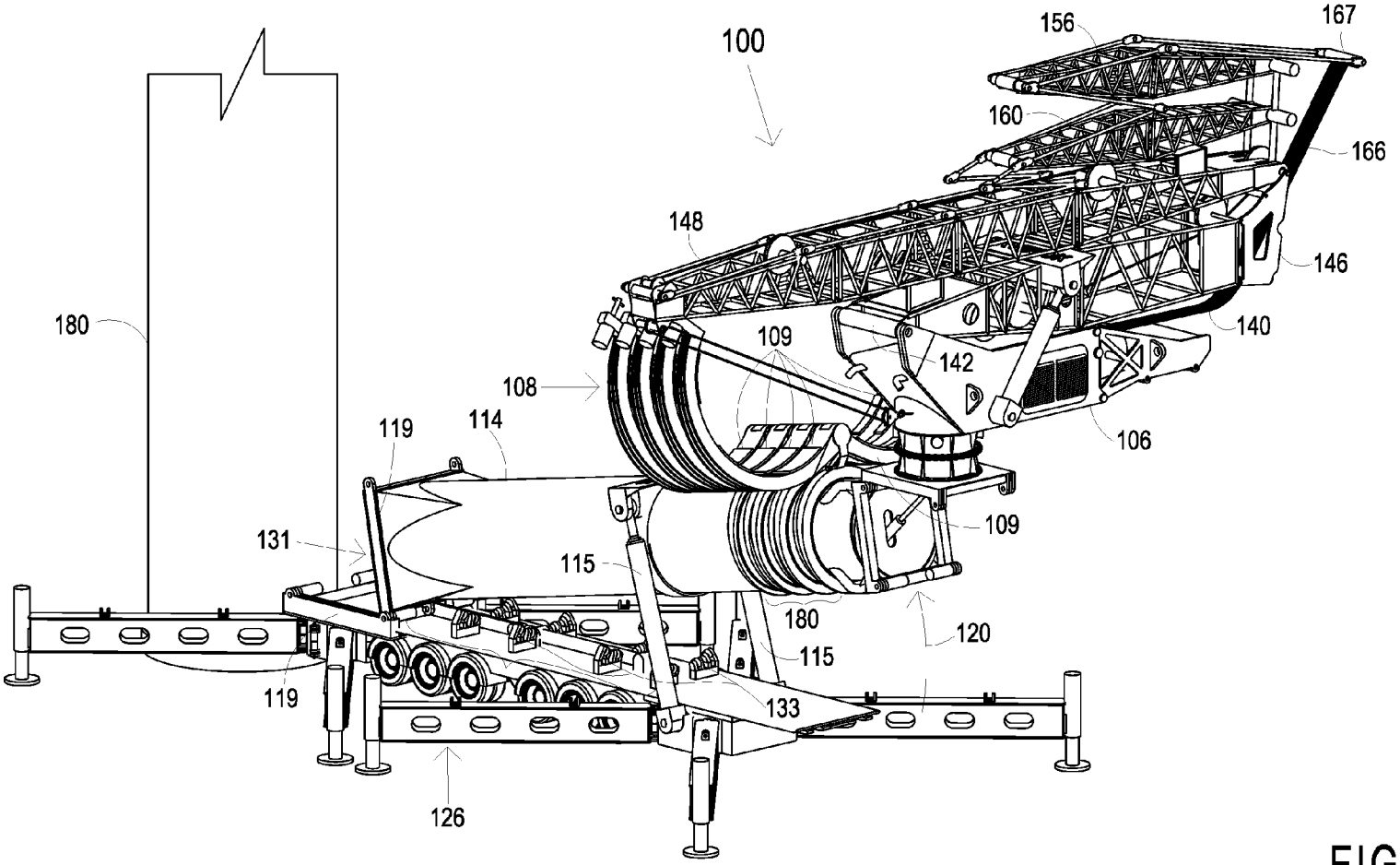
FIG. 3 is a perspective view of a partially deployed enhanced stability crane according to an embodiment of the present invention.
Figure 4:
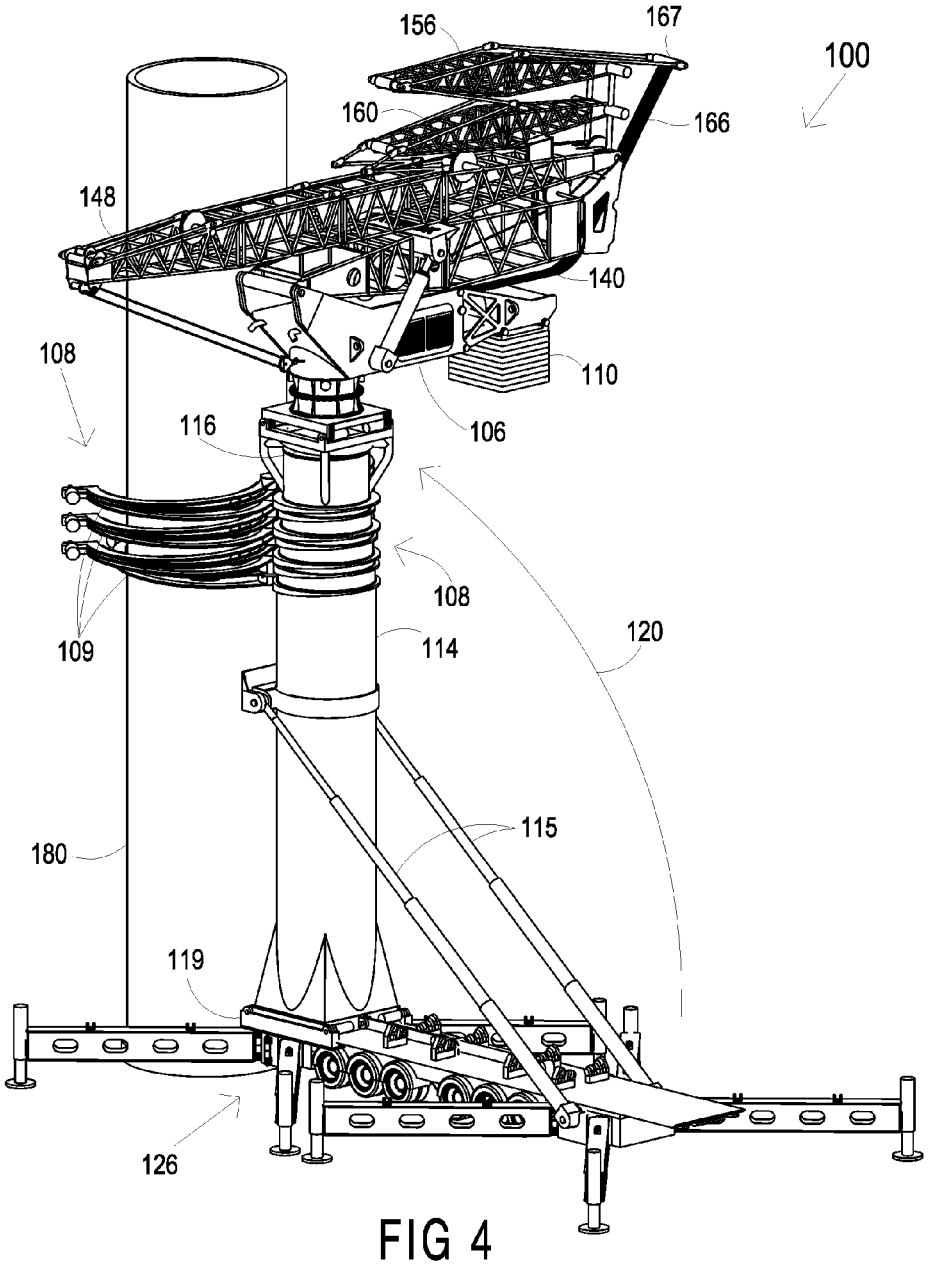
FIG. 4 is a perspective view of a partially deployed enhanced stability crane according to an embodiment of the present invention.

As best seen in FIGS. 1 and 3-4, the main support mast 114 of the first embodiment is coupled to the platform assembly 126 by a mast coupler 119 that has both pivoting and sliding functions. The pivoting function of the mast coupler 119 enables the main support mast 114 to adjust between a prone orientation as shown in FIG. 1, and an upright configuration, as shown in FIGS. 4-8 and 10, while remaining coupled to the platform assembly. The prone orientation of the main support mast is substantially horizontal and the upright configuration is substantially vertical. The sliding function of the mast coupler 119 enables the main support mast 114 to move substantially horizontally, as indicated by arrow 131 in FIG. 3, while the mast 114 remains coupled to the platform assembly 126 with the platform assembly remaining substantially stationary. In order to move into the upright configuration, wherein the main support mast 114 is supported on its second end 118, the mast 114 typically slides away from a tower structure 180 to avoid detrimental impingement thereupon. The tower structure 180 is a base section of a wind turbine tower under construction by use of the crane 100, and is thus not part of the crane itself.

The enhanced stability crane 100 further comprises a boom 140 pivotably coupled to the crane base 106 at a boom first end 144. In the fully deployed configuration, a jib 148 is pivotably coupled to the boom at a boom second end 146. In the fully collapsed configuration illustrated in FIGS. 1 and 2, a first boom mast 156 and a second boom mast 160 reside substantially horizontally oriented above the jib 148, which resides substantially horizontally oriented above the horizontally disposed boom 140. The boom 140, jib 148, and boom masts 156, 160 are components of a boom-jib assembly 172. Variations include a boom-jib comprising less than two boom masts.

Figure 8:
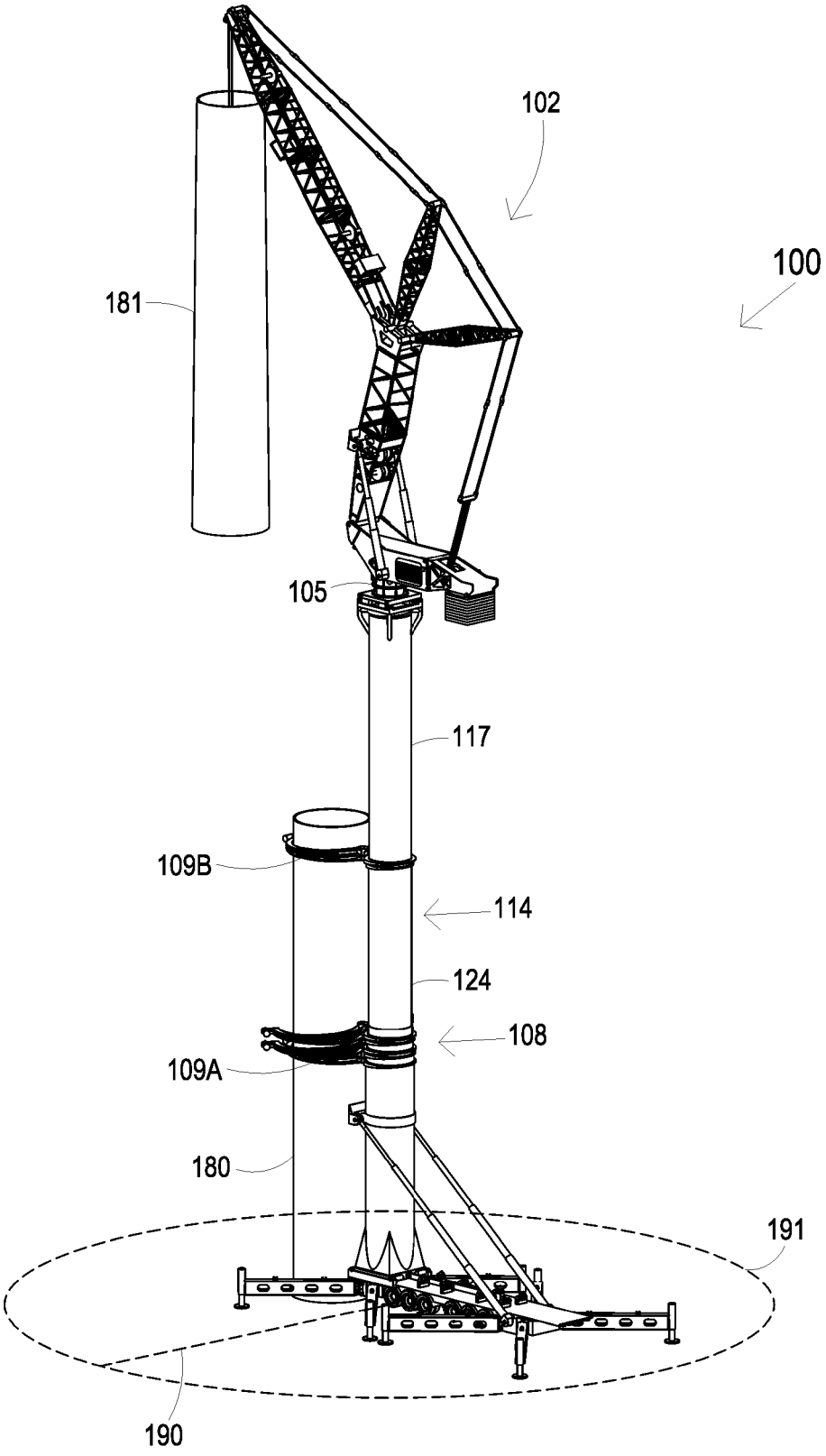
FIG. 8 is a perspective view of a fully deployed enhanced stability crane according to an embodiment of the present invention.

Conversely, in the fully deployed configuration illustrated in FIGS. 7-10, the boom 140 projects upwardly from the crane base 106. The boom angle is adjustable, and is typically operated within 12.5 degrees from vertical. While in the fully deployed configuration, the boom 140 is sometimes leaning back over the crane body, as shown in FIGS. 7-10, at an angle of up to about 15 degrees from vertical that can be referred to as a negative boom angle. As best illustrated in FIG. 8, during normal operation the crane 100 can lift a crane load with the boom at the negative boom angle.

Figure 10:
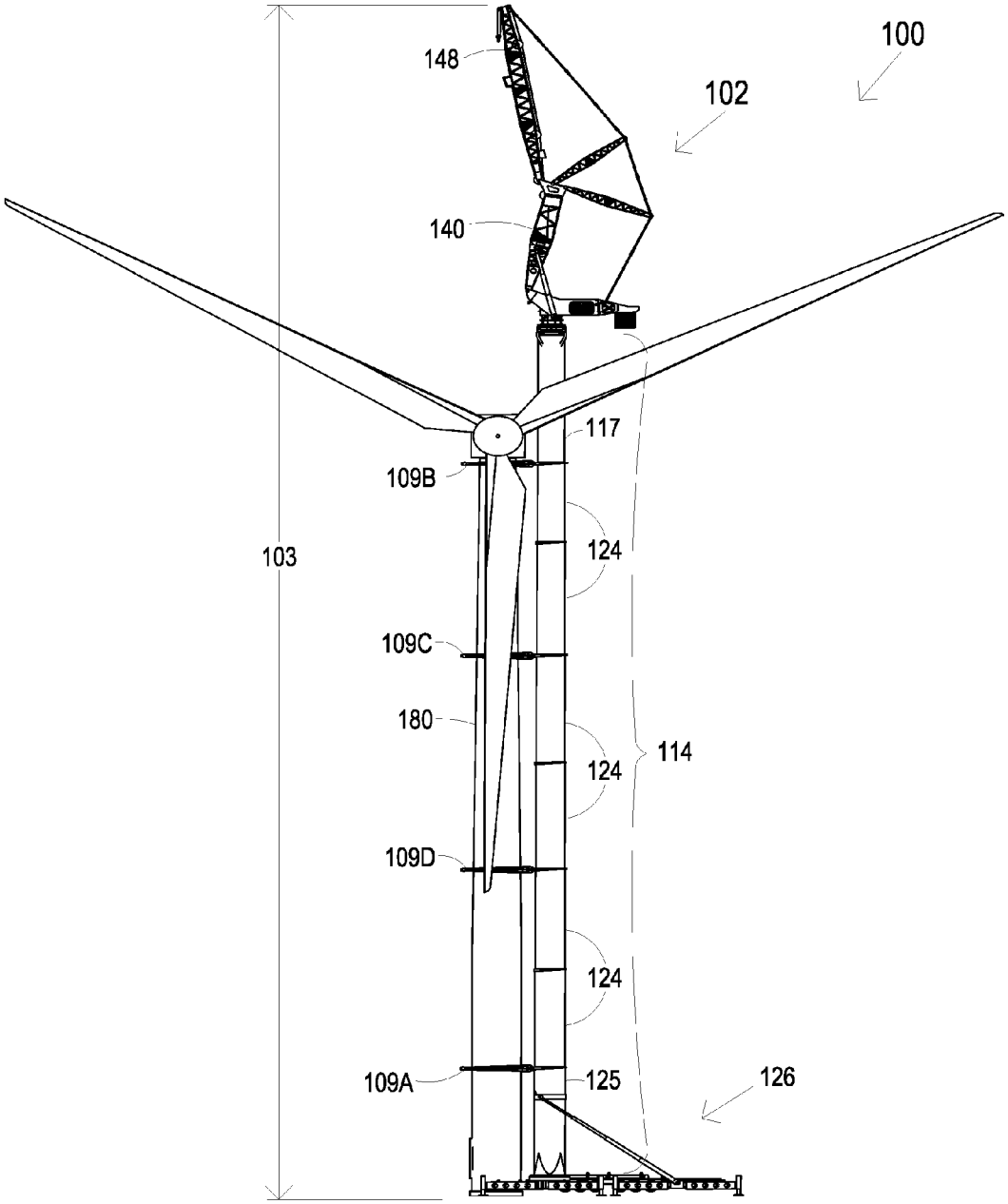
FIG. 10 is a side, plan view of a fully deployed enhanced stability crane according to an embodiment of the present invention.

In the fully deployed configuration and during normal operation, the jib 148 typically projects upwardly from the boom second end 146. Maximum jib height 103 is measured or calculated with the boom 140 being within approximately 12 degrees of vertical and the jib 148 at approximately 9 degrees from vertical, and with the main support mast 114 fully extended, as best shown in FIG. 10. So configured, the first embodiment crane 100 can place a crane load on a tower structure immediately adjacent to the main support mast 114.

In the fully deployed configuration illustrated in FIGS. 7-10, the jib 148, the first boom mast 156, and second boom mast 160 are coupled directly to the boom 140 at a boom second end 146. The jib 148, first boom mast 156, and second boom mast 160 diverge as they project away from the boom 140, i.e. they each project away from the boom at a different angle and no two are parallel, when fully deployed.

The crane 100 further comprises a jib support assembly. The jib support assembly includes the first boom mast 156, the second boom mast 160, and a jib tension assembly. The jib tension assembly includes multiple tension members 165, a cable cluster 166, and a yoke 167. The multiple tension members 165 are operatively coupled to a boom drum 111 (see FIG. 9) via the cable cluster 166 and the yoke 167. The multiple tension members of the first embodiment comprise jointed steel struts. Variations include cables, rods, and similar devices having ample tensile strength and thus being configured to apply tensile force to other structures.

The jib support assembly is configured to rotate the jib 148 about its coupling to the boom 140, thus raising or lowering a jib upper end. Persons skilled in the art recognize that raising or lowering the jib upper end raises or lowers the jib height, and also changes the reach of the crane. Accordingly, raising the jib upper end can be used to move a crane load toward the main support mast, and lowering the jib upper end can be used to move the crane load away from the main support mast.

The first embodiment enhanced stability crane 100 further comprises a boom actuating assembly 141 coupled directly to the boom 140 and the crane base 106, and configured to rotate the boom about the pivotable coupling 142 between the boom and the crane base. The boom actuating assembly 141 of the first embodiment typically includes two six inch double acting 4-stage Hyco® telescoping hydraulic cylinders weighing approximately 1,400 pounds each.

The crane 100 further comprises a main support mast erector assembly 115 adapted to rotate the mast 114 about a pivot point on the mast coupler 119, thus raising or lowering the mast first end 116 and structures residing thereupon. The main support mast erector assembly 115 typically comprises telescoping hydraulic cylinders.

The boom 140, jib 148, first boom mast 156, and second boom mast 160, are typically latticed, and are designed based on stock parts and attachments for a Kobelco® SL 6000 hydraulic crane, scaled to approximately 60% of the stock SL 6000 parts. The boom 140 can be approximately 37.6 feet long and weigh approximately 50,700 pounds. The boom 140 typically includes a boom base section, a tapered boom section, and a luffing boom top section.

The jib 148 can be approximately 60.1 feet long and weigh approximately 13,900 pounds. The jib 148 typically includes a jib top section, two jib insert sections, and a jib base section.

The first and second boom masts 156, 160 are typically, but not necessarily, identical. Each of the boom masts can be approximately 35.4 feet long and weigh approximately 26,600 pounds. The boom masts each typically include two mast top sections. For each boom mast, wide ends of the two mast tops are butted together to create a boom mast that is widest at the middle and tapers toward each end.

Figure 9:
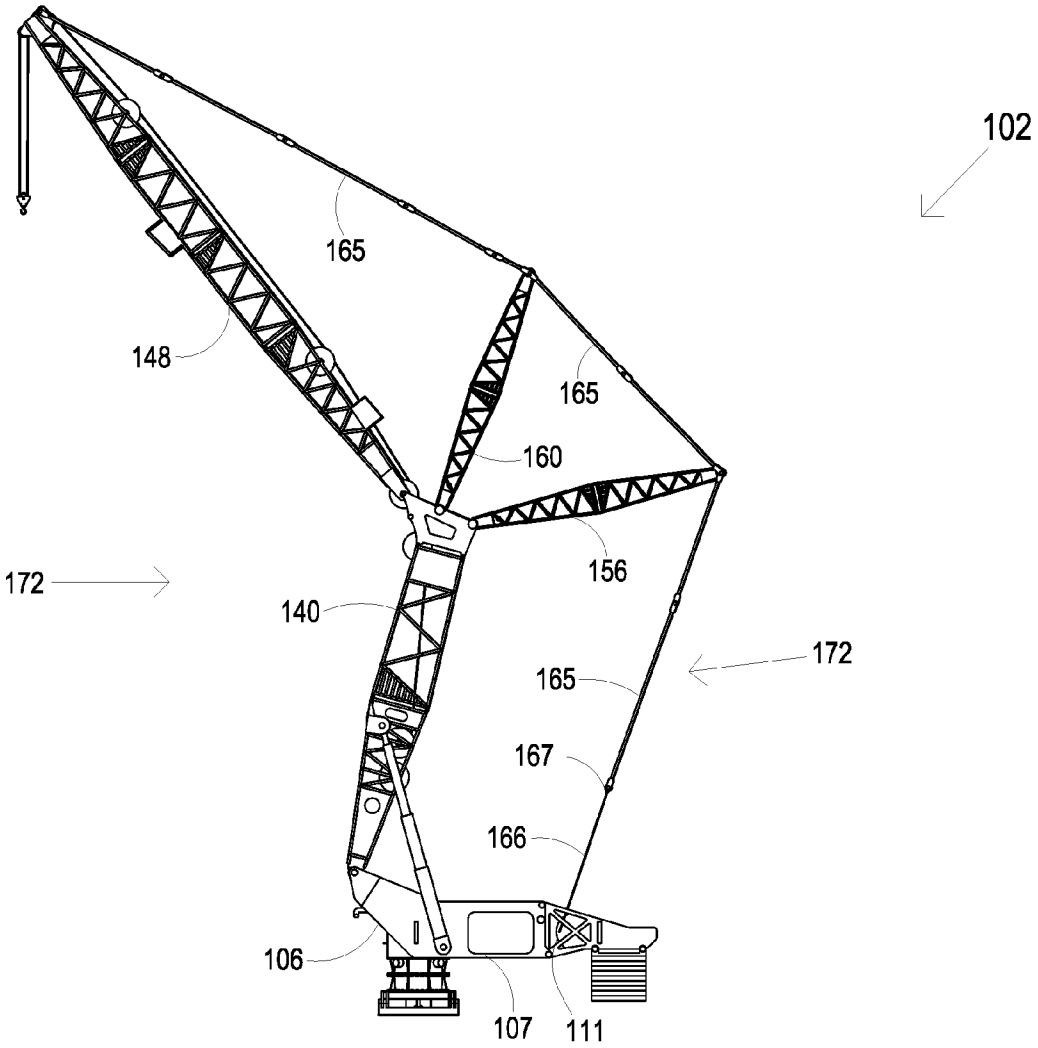
FIG. 9 is a side, plan view of a fully deployed hoist assembly of an enhanced stability crane according to an embodiment of the present invention.

Referring now to FIG. 9, the boom 140, jib 148, boom masts 156, 160, tension members 165, cable cluster 166, and yoke 167 of the first embodiment enhanced stability crane, are collectively referred to as the boom-jib assembly 172. Variations of the boom-jib assembly include at least a boom and jib. The boom 140 and the jib 148 change angles (fold) rather than telescope, in order to change height or reach. The boom-jib assembly 172 and the crane base 106 can be collectively referred to as a hoist mechanism 102.

As best seen in FIG. 8, elongating the telescoping main support mast 114 by extending a middle main mast section 124 results in a taller height for the crane 100. The crane stabilizes at its taller height by grasping the tower structure 180 with a grasping member second set 109B. At the new taller height, the crane 100 is able to lift a crane load 181 above the tower structure 180. The hoist mechanism 102 is able to rotate 360 degrees about a pivoting base 105 that connects the crane base 106 to the main support mast 114 while holding the crane load 181 above the tower structure 180.

With 360 degrees of rotation enabled, the first embodiment enhanced stability crane 100 has a maximum ground operating radius 190 of at least approximately 55 feet, resulting in a ground working area of at least approximately 9503 square feet. However, the crane 100 can not work effectively at a center of the ground working area within a radius of about 9 feet. The result is an effective working area of at least approximately 9249 square feet that is annular in shape because it has a 9 foot radius vacancy in its middle. The operating radius is determined with the boom within 15 degrees of vertical and the jib at 45 degrees from vertical.

FIG. 10 illustrates the first embodiment enhanced stability crane 100 in its fully deployed configuration, with the main support mast 114 fully extended. In its fully extended configuration, the main support mast has a length of approximately 295.6 feet. A main mast base section 125 is supported at a height of about 4.8 feet by the platform assembly. Accordingly, the main support mast rises to a height of approximately 300.4 feet at the top of an upper main mast section 117. Six middle main mast sections 124 reside between the upper and lower main mast sections 117, 125. The middle main mast sections 124 typically extend to a length of 35 to 45 feet between adjacent mast sections when the main support mast 114 is fully extended.

The main support mast can comprise eight telescoping sections. The sections are typically, but not necessarily, cylindrical, and are usually thinner and longer proceeding from bottom to top of the mast. In some embodiments, the sections are between about 9 feet and 7 feet in diameter, and between about 50 feet and 37 feet in length. Telescoping main support masts are typically hydraulically actuated.

The hoist mechanism 102 by itself typically has a maximum jib height of about 106.4 feet, with the boom-jib assembly contributing approximately 96.1 feet. Maximum jib height is determined with the boom within 12 degrees of vertical and the jib within 9 degrees of vertical. Coupling between the main support mast and the hoist mechanism typically adds about 5.2 feet to overall crane height. Accordingly, the first embodiment enhanced stability crane 100 has a maximum jib height of about 412 feet when the main support mast is fully extended. With a block and tackle assembly hanging 12 feet below the jib upper end, the maximum hook height is 400 feet. The crane 100 can thus lift a crane load of up to 110 tons (222,000 pounds) to approximately 400 feet. Other embodiments have a maximum jib height of preferably at least 262 feet, more preferably at least 328 feet, and most preferably at least 400 feet. Variations are capable of lifting, to about a maximum jib height, preferably at least 60 tons (120,000 pounds), more preferably 80 tons (160,000 pounds), and most preferably at least 100 tons (200,000 pounds).

A grasping member first set 109A typically grasps the tower structure 180 at a height of about 44 feet. As best seen in FIG. 10, the grasping member second set 109B is shown grasping the tower structure 180 at a height of about 254 feet; the grasping member third set 109C grasps the tower structure at a height of about 187 feet; and the grasping member fourth set 109D grasps the tower structure 180 at a height of about 113 feet.

Typically the crane 100 extends incrementally as it adds sections to, and thus increases the height of, the tower structure 180. After adding an upper section to the tower structure, the crane typically extends, grasps the tower structure at a higher point for stability, and subsequently lifts another upper section of the tower structure to again add height to the tower.

Embodiments of enhanced stability cranes according to the present invention can lift crane loads as described above without relying on elevated outriggers to augment stability. Clamping assembly of an enhanced stability crane usually stabilizes the crane sufficiently, and elevated outriggers are thus typically absent.

The first embodiment enhanced stability crane preferably has a dry mass, without added counterweights, of preferably less than 110,000 kilograms, more preferably less than 100,000 kilograms, and most preferably approximately 95.5 kilograms.

A First Method of Using an Enhanced Stability Crane

Figure 11:
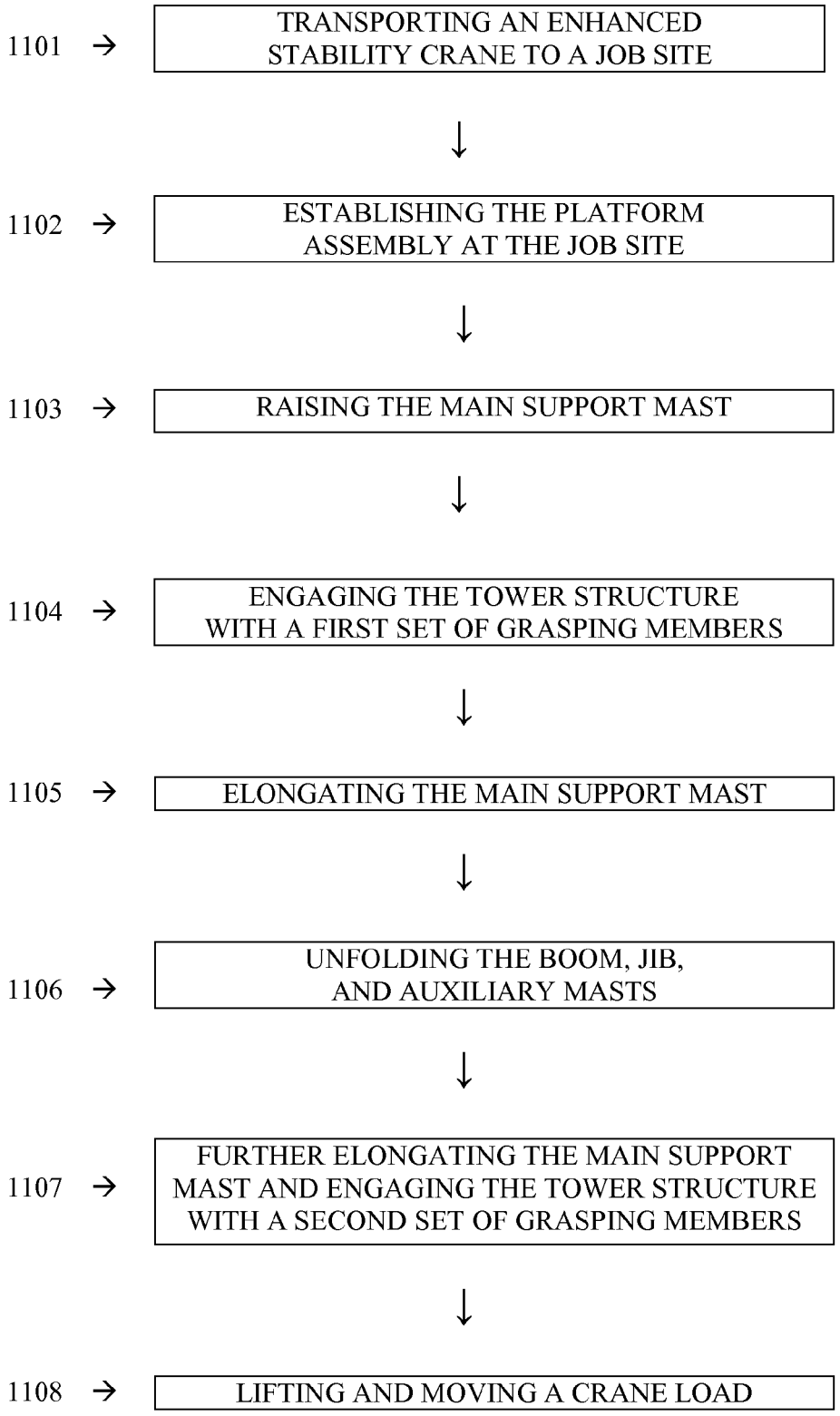
FIG. 11 is a flow chart depicting a method of using an enhanced stability crane according to an embodiment of the present invention.

A first method of using an enhanced stability crane is depicted in a flow chart of FIG. 11. A first operation 1101 of the first method comprises transporting an enhanced stability crane to a jobsite. The crane is a first embodiment enhanced stability crane 100, and is typically collapsed and disassembled for transport, with the main support mast 114 lying prone on the platform assembly 126. The hoist mechanism 102 is typically separate from the main support mast 114 during transport, with the hoist assembly being transported on a first trailer and the main support mast being transported on a second trailer. The clamping assembly 108 is typically transported separate from the main support mast 114 as well.

The second trailer typically includes the platform assembly 126. The platform assembly 126 with the main support mast 114 lying prone thereupon is typically transported by towing behind a road tractor. The platform assembly 126 thus acts as a trailer or semi-trailer. The road tractor and platform assembly 126 together forming a tractor-trailer rig familiar to persons skilled in the art. The tractor-trailer rig can also be referred to as a semi-trailer truck.

The second operation 1102 of the first method comprises establishing the platform assembly 126 at the job site, which includes adjusting the platform assembly 126 to an operational configuration with the ground-level outriggers 130 installed. In the operational configuration as illustrated in FIGS. 1-8 and 10, the platform assembly 126 forms a stable platform from which the crane 100 can deploy and perform. In the second operation of the first method, the platform assembly is established immediately adjacent a tower structure 180. Location of the platform assembly 126 immediately adjacent the tower structure 180 is illustrated in FIGS. 1, 3-8, and 10.

The third operation 1103 comprises raising the main support mast 114. Raising the main support mast includes sliding the mast 114 horizontally, best seen in FIG. 3, while it resides in a prone orientation. The horizontal sliding, indicated in FIG. 3 by arrow 131, enables the main support mast 114 to pivot to an upright orientation without hitting the tower structure 180. The horizontal sliding also enables the main support mast to stand completely on the platform assembly.

Raising the main support mast 114 further includes operating the mast erector assembly 115 to raise the mast first end 116 and rotate the mast 114 about a pivot point disposed on the mast coupler 119. The main support mast 114 is raised/rotated until it resides in an upright configuration. Motion of the mast first end 116 as the main support mast 114 is raised is indicated in FIGS. 3 and 4 by arrow 120.

The fourth operation 1104 comprises engaging the tower structure 180 with the clamping assembly 108. The clamping assembly 108 engages the tower structure 180 by grasping the tower structure 180 securely with the grasping members 109. So secured, the enhanced stability crane 100 is much more stable, and is thus more resistant to destabilizing forces such as those created by wind, and by acceleration and deceleration of crane loads. The clamping assembly 108 is illustrated with a grasping member first set 109A engaged with the tower structure 180 in FIGS. 6, 8, and 10. Counterweights 110 can be installed at a back of the crane base 106 after said engaging the tower structure 180 with the clamping assembly 108. In some embodiments, counterweights can be winched into position by the enhanced stability crane 100. Variations include using an assist crane for installing the counterweights.

Figure 5:
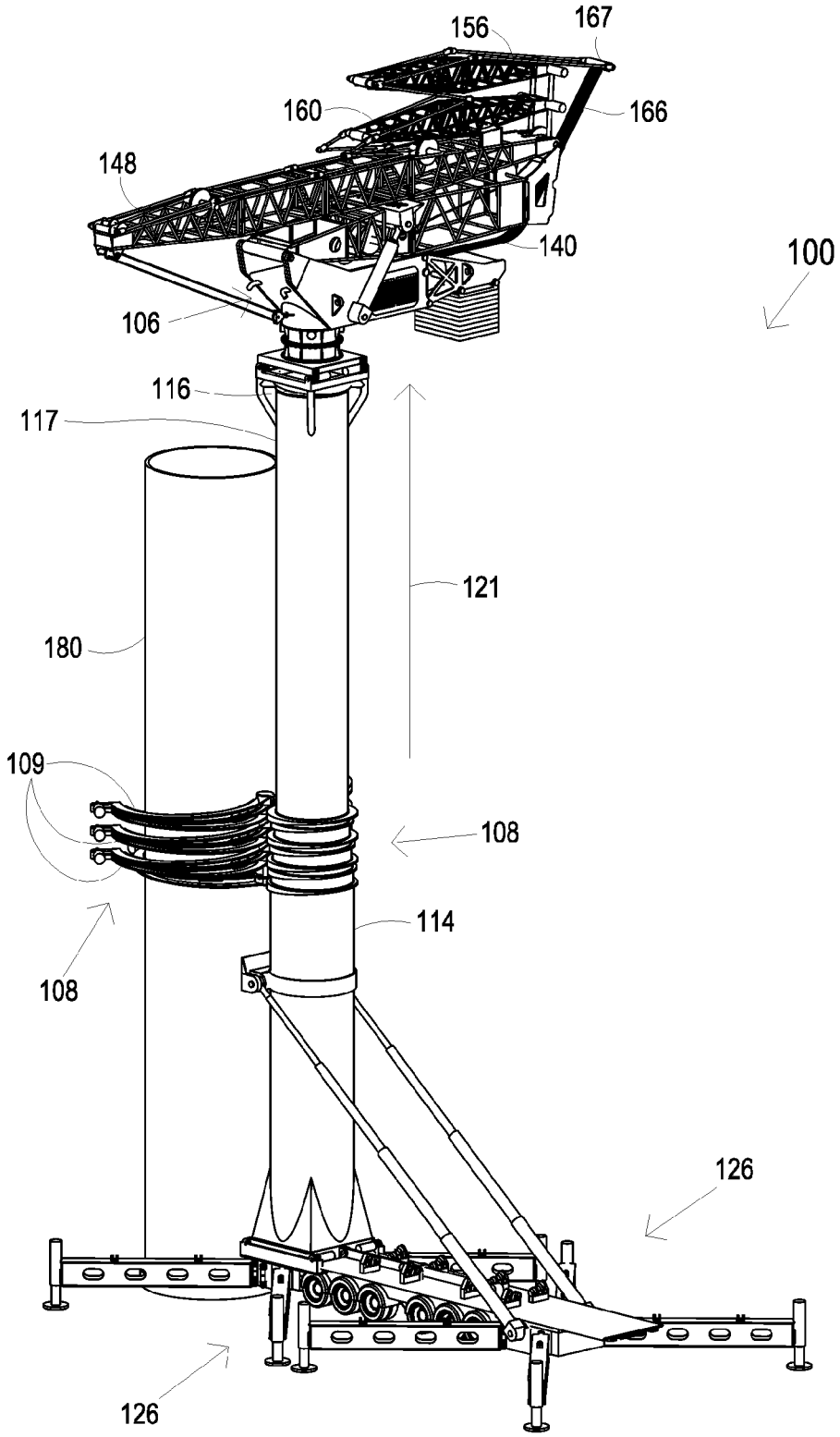
FIG. 5 is a perspective view of a partially deployed enhanced stability crane according to an embodiment of the present invention.

A fifth operation 1105 comprises elongating the main support mast 114 by extending an upper main mast section 117 from its nested position within main mast lower sections, to its partially extended position shown in FIG. 5. Motion of the upper main mast section 117 as it extends is indicated by arrow 121 (see FIG. 5).

Figure 6:
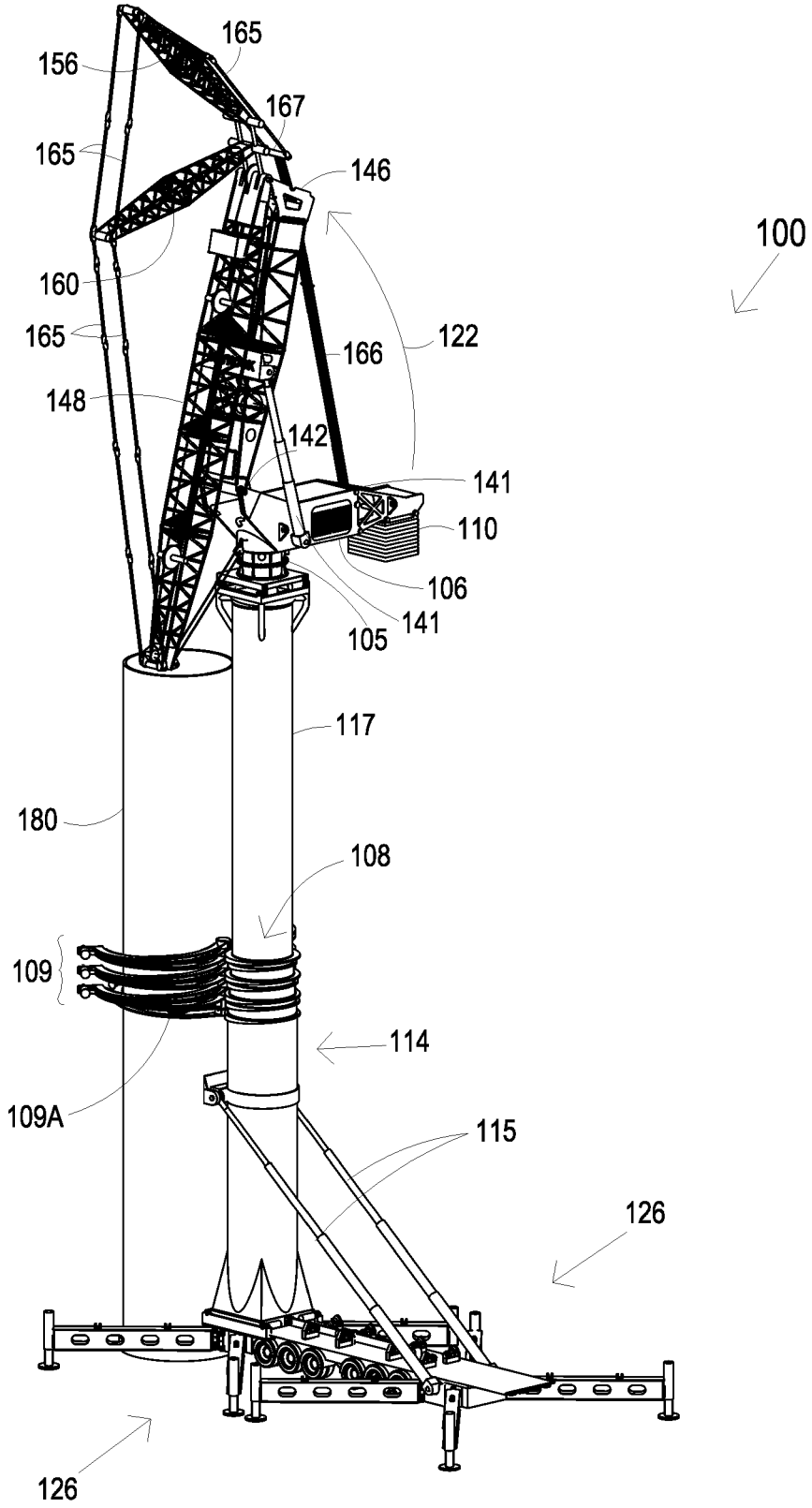
FIG. 6 is a perspective view of a partially deployed enhanced stability crane according to an embodiment of the present invention.
Figure 7:
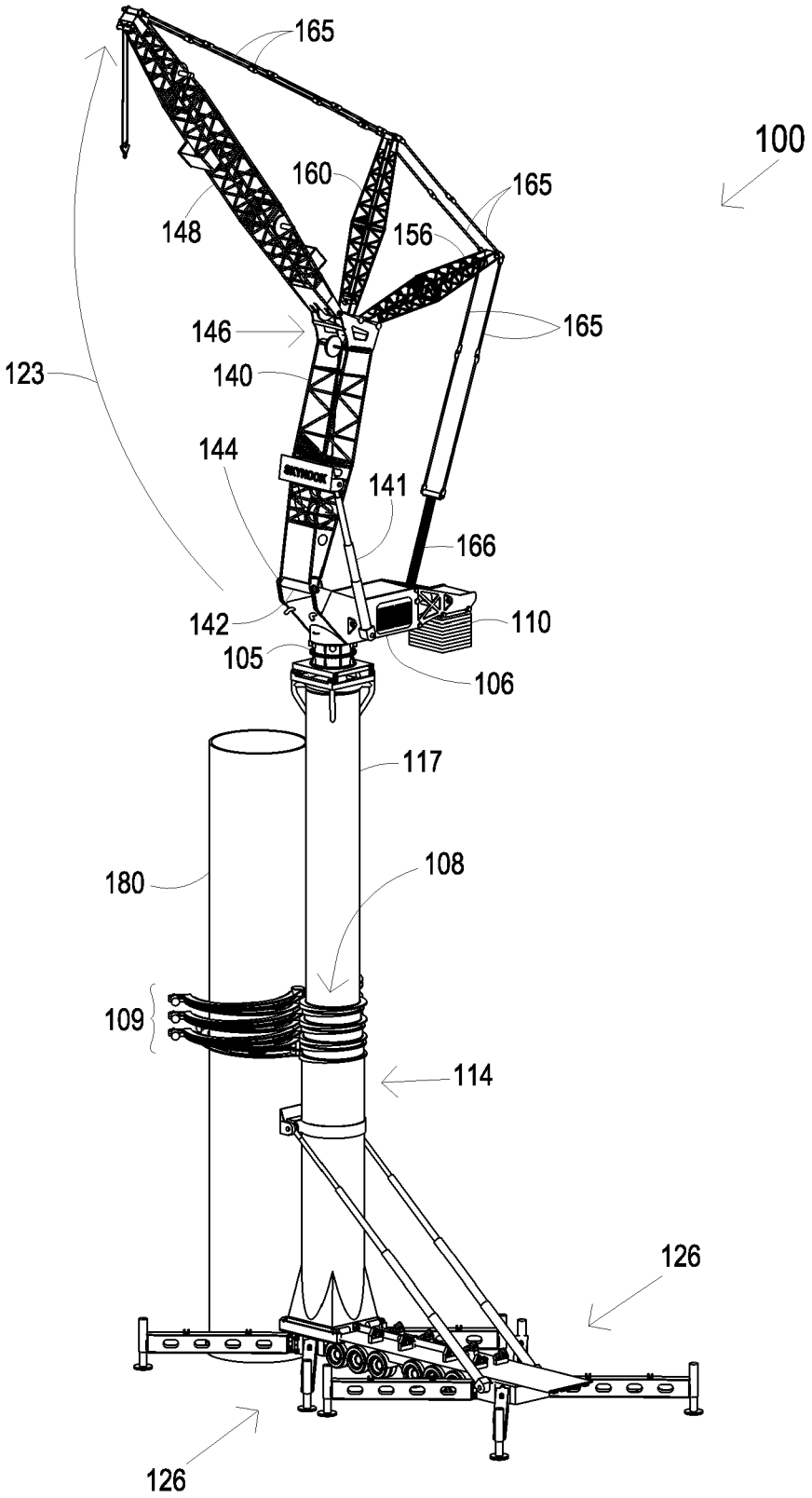
FIG. 7 is a perspective view of a fully deployed enhanced stability crane according to an embodiment of the present invention.

A sixth operation 1106 comprises unfolding the boom 140, jib 148, and boom masts 156, 160, whereupon the enhanced stability crane 100 is in the fully deployed configuration. The boom, jib, and boom masts are shown partially unfolded in FIG. 6, and fully unfolded when the crane 100 is fully deployed, as illustrated in FIGS. 7-10. The sixth operation typically commences with the boom actuating assembly 141 moving the boom 140 into its deployed configuration by raising the boom second end 146, as the boom rotates about the pivotable coupling 142 residing at the boom first end 144. The raising of the boom second end is indicated in FIG. 6 by arrow 122. The sixth operation 1106 continues with the boom drum 111 (best seen in FIG. 9) reeling in the cable cluster 166, which in turn applies tension to the tension members 165. After becoming taut, the tension members 165 draw the boom masts 156, 160 and jib 148 into fully deployed configuration shown in FIGS. 7-10. Movement of the jib 148 into the fully deployed configuration is indicated by arrow 123 in FIG. 7.

A seventh operation 1107 comprises further elongating the telescoping main support mast 114 by extending middle main mast sections 124, and grasping the tower structure 114 with grasping member second set 109B, grasping member third set 109C, and grasping member fourth set 109D, as best illustrated in FIG. 10. Jib height of the crane 100 is thus increased as the crane base 106 reaches a new elevation.

An eighth operation 1108 comprises lifting and moving the crane load 181 with the first embodiment enhanced stability crane 100. The crane load 181 of the seventh operation is a wind turbine tower first upper section, which will be installed on the base section of the tower structure 180, whereupon the upper section becomes part of the tower structure. As the tower structure becomes taller through addition of upper sections, the main support mast 114 typically elongates also, and grasps the tower structure at higher points in order to stabilize the crane 100 as it grows higher.

The first method of using the first embodiment enhanced stability crane 100 requires minimum set up area of 3800 square feet. The required set up area is approximately 52 feet by 73 feet.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. An enhanced stability crane comprising:
- a platform assembly;
- a telescoping main support mast coupled to the platform assembly;
- a crane base mounted on the main support mast;
- a power source residing within the crane base;
- a boom coupled to the crane base at a boom first end and projecting upwardly therefrom;
- a jib pivotably coupled to the boom proximate a boom second end and projecting upwardly therefrom;
- a maximum jib height of at least 262 feet;
- a crane load capacity of at least 160,000 pounds;
- a clamping assembly coupled directly to the main support mast, the clamping assembly being configured to affix securely to a tower structure to stabilize the crane; and
- a jib support assembly comprising a first boom mast, a second boom mast, and a jib tension assembly, the jib support assembly (i) being operatively coupled to the jib and to the power source, and (ii) configured to pivot the jib about the coupling between the jib and the boom second end;
- wherein the jib tension assembly extends from the power source to the first boom mast;
- wherein the second boom mast directly coupled to the jib tension assembly between the first boom mast and the jib;
- wherein in a fully collapsed configuration (i) the main support mast is oriented substantially horizontally on the platform assembly, (ii) the boom and the jib are oriented substantially horizontally with the jib residing above and substantially parallel to the boom, and (iii) the boom and the jib are oriented substantially transverse to the main support mast.

2. The crane of claim 1, wherein the set up area required is less than 4000 square feet.

3. The crane of claim 1, wherein the assembled crane has an operational dry mass of less than 105,000 kilograms.

4. The crane of claim 1, wherein the clamping assembly includes grasping members configured to grasp a tower structure.

5. The crane of claim 1, wherein the boom is pivotably coupled to the crane base at the first boom end.

6. The crane of claim 5, further comprising a boom actuating assembly operatively coupled to the boom and the crane base, and configured to pivot the boom about the pivoting coupling of the boom first end to the crane base.

7. The crane of claim 6, further comprising a main support mast erecting assembly operatively coupled to the main support mast and the platform assembly, and configured to pivot the main support mast about a mast coupler that connects the main support mast to the platform assembly.

8. The crane of claim 7, wherein the mast coupler has both pivoting and sliding functionality.

9. The crane of claim 8, wherein the crane base is pivotably coupled to the main support mast.

10. The crane of claim 7, wherein the main support mast erecting assembly or the jib actuating assembly comprise a hydraulic cylinder.

11. An enhanced stability crane comprising:
- a platform assembly;
- a telescoping main support mast coupled to the platform assembly;
- a crane base coupled to the main support mast;
- a power source residing within the crane base;
- a boom coupled to the crane base at a boom first end;
- a jib;
- a capacity of at least 160,000 pounds; and
- a clamping assembly coupled directly to the main support mast, the clamping assembly being configured to affix securely to a tower structure to stabilize the crane;
- a fully collapsed configuration having a total height of less than 15 feet and including:
  - the main support mast being oriented substantially horizontally on the platform assembly;
  - the boom and jib being oriented substantially horizontally, with the jib residing substantially above and substantially parallel to the boom;
  - the boom and the jib being oriented substantially transverse to the main support mast;
- a fully deployed configuration including:
  - the main support mast standing substantially vertically on the platform assembly;
  - the crane base residing atop the main support mast;
  - the boom projecting upwardly from the crane base;
  - the jib projecting horizontally or upwardly away from the boom.

12. The crane of claim 11, further comprising a first boom mast and a jib tension assembly, wherein:
- the fully collapsed configuration includes the first boom mast residing above the jib and oriented substantially horizontally;
- the fully deployed configuration includes:
  - the first boom mast being coupled to the boom at the boom second end;
  - the first boom mast projecting away from the boom; and
  - jib tension assembly being (i) operatively coupled to the jib, the first boom mast, and to the power source, and (ii) configured to pivot the jib about the coupling between the jib and the boom second end.

13. The crane of claim 12, wherein the fully deployed configuration further includes a maximum jib height of greater than 262 feet.

14. The crane of claim 13, further comprising a second boom mast, wherein:

the fully collapsed configuration includes the second boom mast residing above the jib and oriented substantially horizontally;

the fully deployed configuration includes:

the second boom mast being coupled to the boom at the boom second end;

the second boom mast projecting away from the boom; and the jib tension assembly being further operatively coupled to the second boom mast.

15. A method of using the crane of claim 13 comprising:

transporting the crane to a jobsite in the fully collapsed configuration;

adjusting the main support mast from a substantially horizontal orientation to a substantially vertical orientation while the main support mast remains pivotably coupled to the platform assembly;

telescopically elongating the main support mast;

adjusting the boom from a horizontal orientation to a vertical orientation while the boom remains pivotably coupled to the crane base;

adjusting the jib and first boom mast into the fully deployed orientation; and securing the clamping assembly to a tower structure, said securing the clamping assembly occurring after the main support mast is substantially vertically oriented.

16. The method of claim 15, wherein the clamping assembly includes grasping members and said securing the clamping assembly to the tower structure includes grasping the tower structure with the grasping members.

17. The method of claim 16, wherein the tower structure has an elliptical horizontal cross-section where the grasping members grasp the tower structure.

* * * * *